US008490610B2

(12) United States Patent
Kato

(10) Patent No.: US 8,490,610 B2
(45) Date of Patent: Jul. 23, 2013

(54) CONTROL DEVICE FOR INTERNAL COMBUSTION ENGINE

(75) Inventor: Toshihiro Kato, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 231 days.

(21) Appl. No.: 13/003,812

(22) PCT Filed: Nov. 26, 2009

(86) PCT No.: PCT/JP2009/069906
§ 371 (c)(1),
(2), (4) Date: Jan. 12, 2011

(87) PCT Pub. No.: WO2010/067712
PCT Pub. Date: Jun. 17, 2010

(65) Prior Publication Data

US 2011/0259308 A1 Oct. 27, 2011

(30) Foreign Application Priority Data

Dec. 8, 2008 (JP) ..... 2008-312392

(51) Int. Cl.
*F02D 41/00* (2006.01)

(52) U.S. Cl.
USPC ..... 123/690; 123/198 DB; 701/108; 477/181

(58) Field of Classification Search
CPC ..... F02D 41/02; F02D 41/04; F02D 41/12
USPC ..... 123/325, 326, 493, 568.11, 568.16, 123/198 D, 198 DB, 198 F, 690–693; 701/103, 701/104, 108, 112, 114; 477/107, 100, 111, 477/168, 181; 73/114.69, 114.74
See application file for complete search history.

(56) References Cited

U.S. PATENT DOCUMENTS 5,653,212 A * 8/1997 Hotta et al. ..... 123/568.16

(Continued)

FOREIGN PATENT DOCUMENTS

| | | |
|---|---|---|
| JP | A-6-249079 | 9/1994 |
| JP | A-11-101144 | 4/1999 |
| JP | A-2002-4901 | 1/2002 |
| JP | A-2005-75066 | 3/2005 |
| JP | A-2006-194146 | 7/2006 |

OTHER PUBLICATIONS

International Search Report issued in International Application No. PCT/JP2009/069906 on Dec. 22, 2009 (with translation).

(Continued)

*Primary Examiner* — John Kwon
*Assistant Examiner* — Johnny Hoang
(74) *Attorney, Agent, or Firm* — Oliff & Berridge, PLC

(57) ABSTRACT

An EG-ECU suspends fuel cutoff when the fuel cutoff is being carried out and the engine speed NE becomes lower than or equal to the resumption engine speed NErtn. The EG-ECU forcibly opens and closes an EGR valve when the fuel cutoff is being carried out, and performs abnormality diagnosis for an EGR device based on a change amount of pressure in an intake pipe caused by opening and closing the EGR valve. The EG-ECU suspends the diagnosis when the diagnosis is being carried out and the engine speed NE becomes lower than or equal to a forcible suspension engine speed NEoff. When the diagnosis is being performed, the EG-ECU sets the forcible suspension engine speed NEoff to a smaller value when the EGR valve is not in a forcibly opened state than when the EGR valve is in the forcibly opened state. Specifically, the EG-ECU sets the forcible suspension engine speed NEoff in such a manner that an allowance ΔNEallw of the forcible suspension engine speed NEoff with respect to the resumption engine speed NErtn has a smaller value when the EGR valve is not in the forcibly opened state than when the EGR valve is in the forcibly opened state.

20 Claims, 6 Drawing Sheets

U.S. PATENT DOCUMENTS

| | | | | |
|---|---|---|---|---|
| 7,100,586 | B2 * | 9/2006 | Matsumoto | 123/568.16 |
| 7,565,901 | B2 * | 7/2009 | Furuta et al. | 123/568.16 |
| 7,698,048 | B2 * | 4/2010 | Jung et al. | 701/103 |
| 2001/0053954 | A1 | 12/2001 | Kawaguchi et al. | |
| 2010/0263627 | A1 * | 10/2010 | Whitney et al. | 123/399 |

OTHER PUBLICATIONS

International Preliminary Report on Patentability issued Jul. 5, 2011 in International Application No. PCT/JP2009/069906.

* cited by examiner (a) Fuel Cutoff Control
Performed
Suspended
(b) Abnormality Diagnosis Control
Being Performed
Being Suspended
(c) EGR Valve Opening Degree
Open
Fully Closed
Fully Closed
(d) Engine Speed NE
NEoff2
ΔNEallwmax
NErtn
(e) State of Torque Converter
Lockup State
Non-lockup State
t21
t22
t23
t24
t25
t26
Time t

CONTROL DEVICE FOR INTERNAL COMBUSTION ENGINE

FIELD OF THE INVENTION

The present invention relates to a control device for an internal combustion engine that opens and closes an exhaust gas recirculation valve (an EGR valve) in a forcible manner when fuel cutoff control is being performed, and diagnoses whether an abnormality has occurred in the EGR device based on the extent of pressure change in the intake passage caused by opening or closing the EGR valve.

BACKGROUND OF THE INVENTION

Conventionally, as one such control device for the internal combustion engine, a device described in Patent Document 1, for example, is known. A typical conventional control device, including the device described in Patent Document 1, opens and closes an EGR valve in a forcible manner when fuel cutoff control is being carried out and determines the pressure change amount ΔP in the intake passage caused by opening or closing the EGR valve. The control device diagnoses whether an abnormality has occurred in the EGR device based on the pressure change amount LP. Specifically, the greater the degree of clogging of the EGR passage, the smaller the pressure change amount ΔP becomes. Accordingly, when the pressure change amount ΔP is lower than or equal to a predetermined value, it is determined that an abnormality has occurred in the EGR device.

During the fuel cutoff control, when the engine speed falls below a predetermined resumption engine speed, the above-described control device for the engine suspends the fuel cutoff control and resumes fuel supply to the engine.

In some cases, even after the engine speed falls below the resumption engine speed, diagnosis as to whether the EGR device has an abnormality may remain incomplete and the EGR valve is maintained open. In these cases, exhaust gas is introduced into the intake passage through the EGR passage, which may cause poor combustion performance in the engine and excessive decrease in the engine speed.

To solve these problems, in conventional techniques, a predetermined forcible suspension engine speed, which is an engine speed higher than the resumption engine speed, is set. When the engine speed falls below the forcible suspension engine speed while the aforementioned diagnosis is being performed, the EGR valve is forcibly closed and the diagnosis is suspended. Further, since the resumption engine speed is variably set, the forcible suspension engine speed is set to a value greater than or equal to the maximum value of the resumption engine speed to prevent excessive decrease of the engine speed even when the resumption engine speed is set to its maximum value. This prevents degradation of the combustion performance of the engine caused by the EGR valve that is held open after the fuel cutoff control is suspended.

PRIOR ART DOCUMENT

Patent Document

Patent Document 1: Japanese Laid-Open Patent Publication No. 2006-194146

SUMMARY OF THE INVENTION

However, the conventional control device for the engine sets the forcible suspension engine speed to a comparatively great fixed value. Accordingly, the engine speed is likely to be lower than the forcible suspension engine speed when the aforementioned diagnosis is being performed, thus lowering the frequency of the completion of the diagnosis. However, if the forcible suspension engine speed is set to a comparatively small fixed value, there may be cases in which the forcible suspension engine speed is lower than the resumption engine speed for certain operating states of the engine. In these cases, excessive decrease of the engine speed after suspension of the fuel cutoff control cannot be avoided.

These problems are not restricted to control devices that set the resumption engine speed variably in accordance with the engine operating state. The problems are generally common in control devices that suspend the fuel cutoff control based on the fact that the engine speed becomes lower than or equal to a predetermined resumption engine speed when the fuel cutoff control is being carried out.

Accordingly, it is an objective of the present invention to provide a control device for an internal combustion engine that increases the frequency of completion of diagnosis whether an EGR device has an abnormality, while preventing an excessive drop of the engine speed.

To achieve the foregoing objective, the present invention provides a control device for an internal combustion engine. The engine includes an EGR device having an EGR passage for introducing exhaust gas from an exhaust passage into an intake passage and an EGR valve arranged in the EGR passage and which varies the amount of the exhaust gas introduced into the intake passage. The control device includes fuel cutoff control means, diagnosis means, and forcible suspension means. The fuel cutoff control means performs fuel cutoff control by which fuel supply to the engine is blocked, and suspends the fuel cutoff control in a condition in which engine speed becomes lower than or equal to a predetermined resumption engine speed when the fuel cutoff control is being carried out. The diagnosis means forcibly opens and closes the EGR valve when the fuel cutoff control means is performing the fuel cutoff control, and diagnoses whether an abnormality has occurred in the EGR device based on extent of pressure change in the intake passage caused by opening and closing the EGR valve. When the diagnosis means is performing the diagnosis, the forcible suspension means suspends the diagnosis in a condition in which the engine speed becomes lower than or equal to a predetermined forcible suspension engine speed equal to or greater than the resumption engine speed. The forcible suspension means sets a smaller value as the forcible suspension engine speed when the EGR valve is not in a forcibly opened state than when the EGR valve is in the forcibly opened state.

When the diagnosis is being carried out, introduction of the exhaust gas into the intake passage through the EGR passage does not occur if the EGR valve is not in a forcibly opened state: Accordingly, compared to when the EGR valve is in the forcibly opened state, excessive decrease of the engine speed caused by the exhaust gas introduced into the intake passage through the EGR passage is unlikely to happen even if the diagnosis is continued until the engine speed drops to a lower value. In the above-described configuration, the forcible suspension engine speed is set to a smaller value when the EGR valve is not in the forcibly opened state than when the EGR valve is in the forcibly opened state, during the diagnosis. Accordingly, compared to, for example, the conventional technique in which the forcible suspension engine speed is set to a comparatively great fixed value, the diagnosis is continued until the engine speed decreases to a smaller value. This decreases the frequency for cases in which the diagnosis is forcibly suspended due to the engine speed that has become lower than or equal to the forcible suspension engine speed when the diagnosis is being carried out. Further, since the forcible suspension engine speed is set to a value equal to or greater than the resumption engine speed, the engine speed is prevented from being excessively reduced through variable setting of the forcible suspension engine speed. As a result, excessive decrease of the engine speed is prevented and the frequency of completion of the diagnosis whether an abnormality has occurred in the EGR device is increased.

The present invention may be configured such that the forcible suspension means sets the forcible suspension engine speed in such a manner that the difference between the forcible suspension engine speed and the resumption engine speed is a smaller value when the EGR valve is not in the forcibly opened state than when the EGR valve is in the forcibly opened state.

In accordance with one aspect of the present invention, the fuel cutoff control means sets the resumption engine speed variably in accordance with an engine operating state, and the forcible suspension means sets the forcible suspension engine speed in such a manner that the greater the resumption engine speed, the smaller the difference between the forcible suspension engine speed and the resumption engine speed becomes.

Typically, when the engine operating state is such that the engine speed can easily drop, the resumption engine speed is set to a great value to provide an allowance therefor. In the above-described configuration, the forcible suspension engine speed is set in such a manner that the difference between the forcible suspension engine speed and the resumption engine speed becomes smaller as the resumption engine speed becomes greater. Despite such setting of the forcible suspension engine speed with a small difference with respect to the resumption engine speed, excessive decrease of the engine speed is prevented by the resumption engine speed being set to the great value with the allowance.

In accordance with one aspect of the present invention, the engine is connected to a transmission through a clutch in a power transmissible manner. When the EGR valve is in the forcibly opened state, the forcible suspension means sets the forcible suspension engine speed to a grater value when the rotation speed of an output shaft of the clutch and the engine speed differ from each other to a great extent than when such extent is small.

When the diagnosis is being carried out and the EGR valve is in the forcibly opened state, the engine speed will later drop to a greater extent when the rotation speed of the output shaft of the clutch and the engine speed differ from each other to a great extent than when such extent is small. In the above-described configuration, the forcible suspension engine speed has a greater value when the rotation speed of the output shaft of the clutch and the engine speed differ from each other to a great extent than when such extent is small. This reliably prevents excessive decrease of the engine speed.

In accordance with one aspect of the present invention, the clutch is a torque converter configured as a fluid clutch and includes a pump impeller connected to an output shaft of the engine, a turbine runner connected to an input shaft of the transmission, and a lockup mechanism for mechanically connecting the pump impeller and the turbine runner to each other. When the EGR valve is in the forcibly opened state, the forcible suspension means sets the forcible suspension engine speed to a greater value when the torque converter is in a non-lockup state than when the torque converter is in a lockup state.

During the diagnosis, when the EGR valve is in the forcibly opened state and the torque converter is not in the lockup state, the engine speed will later drop to a great extent. In the above-described configuration, the forcible suspension engine speed has a greater value when the torque converter is in the non-lockup state than when the torque converter is in the lockup state. This reliably prevents excessive decrease of the engine speed.

In accordance with a further aspect of the present invention, a control device for an internal combustion engine is provided. The engine includes an EGR device having an EGR passage for introducing exhaust gas from an exhaust passage into an intake passage and an EGR valve arranged in the EGR passage and which varies the amount of the exhaust gas introduced into the intake passage. The control device includes fuel cutoff control means, diagnosis means, and forcible suspension means. The fuel cutoff control means performs fuel cutoff control by which fuel supply to the engine is blocked, and suspends the fuel cutoff control during a condition in which engine speed becomes lower than or equal to a predetermined resumption engine speed when the fuel cutoff control is being carried out. The diagnosis means forcibly opens and closes the EGR valve when the fuel cutoff control means is performing the fuel cutoff control, and diagnoses whether an abnormality has occurred in the EGR device based on extent of pressure change in the intake passage caused by opening and closing the EGR valve. When the diagnosis means is performing the diagnosis, the forcible suspension means suspends the diagnosis in a condition in which the engine speed becomes lower than or equal to a predetermined forcible suspension engine speed equal to or greater than the resumption engine speed. When the diagnosis means is performing the diagnosis, the forcible suspension means updates the forcible suspension engine speed at predetermined cycles in accordance with a latest open/closed state at the time of the EGR valve, and sets the forcible suspension engine speed in such a manner that an allowance of the forcible suspension engine speed with respect to the resumption engine speed is a smaller value when the EGR valve is not in a forcibly opened state than when the EGR valve is in the forcibly opened state.

In the above-described configuration, as in the previous cases, the excessive decrease of the engine speed is prevented and the frequency of completion of the diagnosis as to whether an abnormality has occurred in the EGR device is increased.

The fuel cutoff control means can be embodied in the form in which the resumption engine speed is set variably in accordance with the engine operating state. In other words, the forcible suspension engine speed is set by varying the allowance of the forcible suspension engine speed with respect to the resumption engine speed in accordance with the open/closed state of the EGR valve and adding the margin of allowance to the resumption engine speed, which is variably set.

In accordance with one aspect of the present invention, the forcible suspension means sets the forcible suspension engine speed in such a manner that the greater the resumption engine speed, the smaller the allowance with respect to the resumption engine speed becomes.

Typically, when the engine operating state is such that the engine speed can easily drop, the resumption engine speed is set to a great value to provide for allowance. In the above-described configuration, the forcible suspension engine speed is set in such a manner that the allowance of the forcible suspension engine speed with respect to the resumption engine speed becomes smaller as the resumption engine speed becomes greater. Despite such setting of the forcible suspension engine speed with a small allowance with respect to the resumption engine speed, excessive decrease of the engine speed is prevented by the resumption engine speed that is set to the great value with the allowance.

In accordance with one aspect of the present invention, the engine is connected to a transmission through a clutch in a power transmissible manner. When the EGR valve is in the forcibly opened state, the forcible suspension means sets the forcible suspension engine speed in such a manner that the allowance with respect to the resumption engine speed has a greater value when the rotation speed of an output shaft of the clutch and the engine speed differ from each other to a great extent than when such extent is small.

When the diagnosis is being carried out and the EGR valve is in the forcibly opened state, the engine speed will later drop to a greater extent when the rotation speed of the output shaft of the clutch and the engine speed differ from each other to a great extent than when such extent is small.

In the above-described configuration, the forcible suspension engine speed is set in such a manner that the allowance of the forcible suspension engine speed with respect to the resumption engine speed is greater when the rotation speed of the output shaft of the clutch and the engine speed differ from each other to a great extent than when such extent is small. This reliably prevents excessive decrease of the engine speed.

The above described configuration may be embodied such the clutch is a torque converter configured as a fluid clutch and includes a pump impeller connected to an output shaft of the engine, a turbine runner connected to an input shaft of the transmission, and a lockup mechanism for mechanically connecting the pump impeller and the turbine runner to each other, and that the control device further includes control means that outputs a command signal to the lockup mechanism and controls to switch the torque converter to either a lockup state or a non-lockup state by changing an output mode of the command signal.

In accordance with one aspect of the present invention, when the command signal instructing the torque converter to switch to the lockup state is not output from the control means, the forcible suspension means sets the forcible suspension engine speed with the allowance with respect to the resumption engine speed set to a maximum value.

During the diagnosis, when the EGR valve is in the forcibly opened state and the torque converter is not in the lockup state, the engine speed will later drop to a great extent. In the above-described configuration, when the command signal instructing the torque converter to switch to the lockup state is not output from the control means, the forcible suspension engine speed is set with the allowance with respect to the resumption engine speed set to the maximum value of the allowance. This reliably prevents excessive decrease of the engine speed.

In accordance with one aspect of the present invention, when the rotation speed of the turbine runner and the engine speed differ from each other to an extent that is less than a predetermined extent, the forcible suspension means sets the forcible suspension engine speed in such a manner that, the greater the resumption engine speed, the smaller the allowance with respect to the resumption engine speed becomes.

Even when the command signal instructing the torque converter to switch to the lockup state is output from the control means, there may be cases in which the pump impeller and the turbine runner are not actually mechanically connected to each other, or, in other words, the lockup state has not been brought about. Accordingly, if the forcible suspension engine speed is set on condition that the command signal instructing the torque converter to switch to the lockup state is output from the control means, the forcible suspension engine speed may not be adequately set, which may lead to excessive decrease of the engine speed.

However, in the above-described configuration, it is determined that the torque converter is in the lockup state on condition that the rotation speed of the turbine runner and the engine speed differ from each other to an extent less than a predetermined extent. When such determination is made, the forcible suspension engine speed is set in such a manner that the allowance with respect to the resumption engine speed becomes smaller as the resumption engine speed becomes greater. As a result, the forcible suspension engine speed is set adequately in accordance with the actual state of the torque converter and excessive decrease of the engine speed is reliably prevented.

In accordance with one aspect of the present invention, when the EGR valve is not in the forcibly opened state, the forcible suspension means sets the forcible suspension engine speed in such a manner that the forcible suspension engine speed becomes equal to the resumption engine speed. In this case, the forcible suspension engine speed has the same value as the resumption engine speed. This further decreases the frequency for cases in which the diagnosis is forcibly suspended due to the engine speed that has become lower than or equal to the forcible suspension engine speed when the diagnosis is being carried out.

In accordance with one aspect of the present invention, when performing the diagnosis, the diagnosis means forcibly opens the EGR valve from a fully closed state.

In accordance with one aspect of the present invention, the diagnosis means uses an average of a plurality of pressure values detected in a predetermined period as the pressure in the intake passage.

The above-described configuration reduces influence by pressure fluctuation in the intake passage and improves accuracy of the diagnosis. In this case, the time necessary to complete the diagnosis is extended, which may increase the frequency of cases in which the diagnosis is forcibly suspended due to an engine speed that has become lower than or equal to the forcible suspension engine speed. However, the present invention is originally configured in such a manner as to increase the frequency of completion of the diagnosis as to whether an abnormality has occurred in the EGR device. Accordingly, despite the use of the average of the pressure values detected in the predetermined period for the pressure in the intake passage, the increase of the frequency of forcible suspension of the diagnosis is maximally avoided.

In accordance with one aspect of the present invention, the forcible suspension means sets the forcible suspension engine speed only when the diagnosis means is performing the diagnosis.

In the above-described configuration, the forcible suspension engine speed is set only when necessary. This prevents increase of calculation load on the control device.

DETAILED DESCRIPTION OF THE PREFERRED EMBODIMENTS

An embodiment of a control device for an internal combustion engine according to the present invention, which is embodied as a control device for an internal combustion engine mounted in a vehicle, will now be described with reference to FIGS. 1 to 6.

Figure 1:
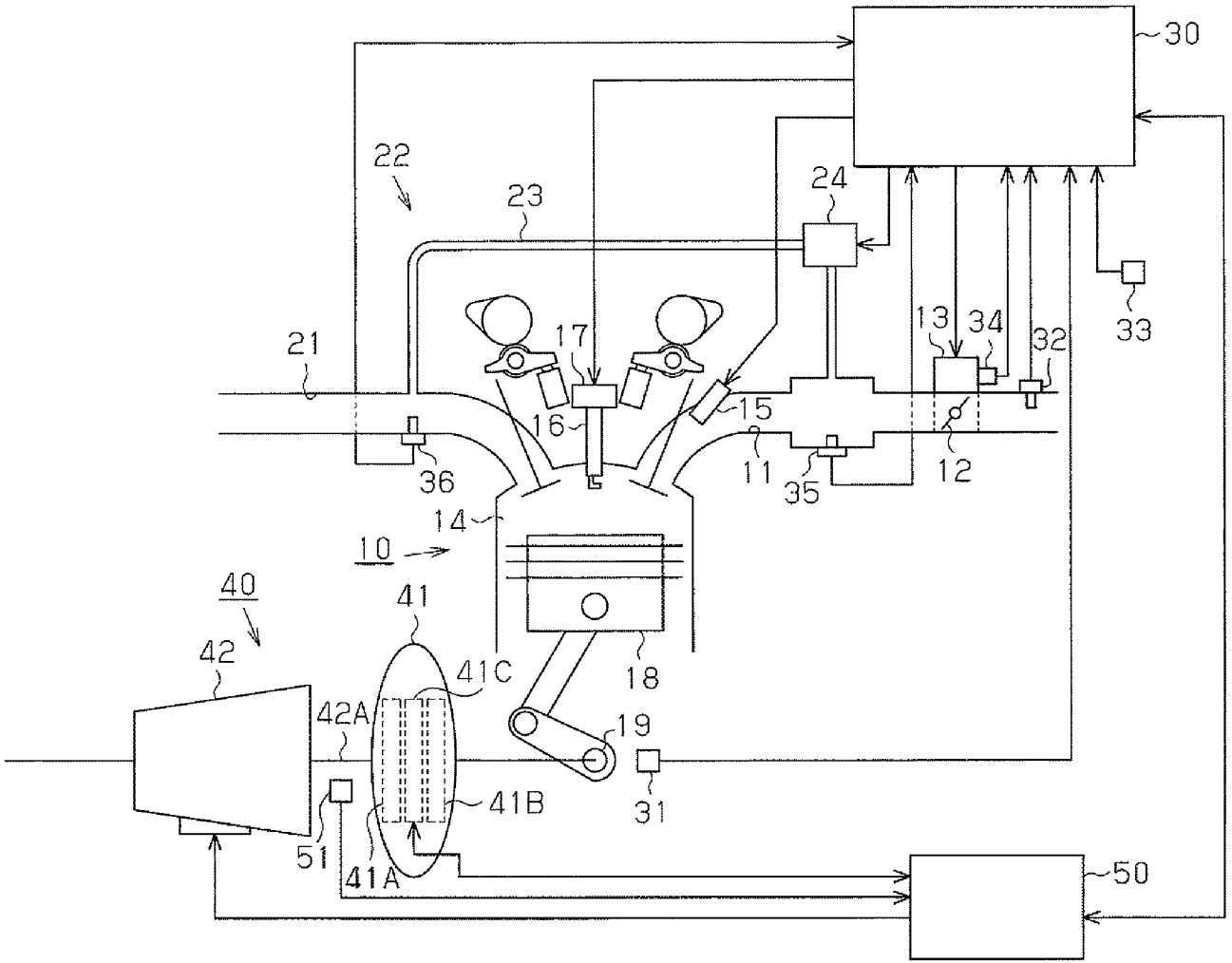
FIG. 1 is a block diagram schematically illustrating the configuration of a control device for an internal combustion engine according to one embodiment of the present invention.

FIG. 1 schematically illustrates the configuration of a control device for an internal combustion engine (hereinafter, referred to as an engine) 10 mounted in a vehicle.

With reference to FIG. 1, a throttle valve 12, which is driven by a throttle motor 13, is arranged in an intake passage 11 of the engine 10. The opening degree of the throttle valve 12 (hereinafter "the throttle opening degree") TA is adjusted through control of operation of the throttle motor 13 (hereinafter, referred to as "throttle opening degree control"), so as to regulate the amount of intake air fed into a combustion chamber 14 via the intake passage 11. A fuel injection valve 15 is provided in the intake passage 11. Fuel is injected into the intake passage 11 through control of operation of the fuel injection valve 15 (hereinafter, "fuel injection control").

A spark plug 16, which sparks to ignite an air-fuel mixture, or mixture of the intake air and the injected fuel in the combustion chamber 14, is arranged in the engine 10. An igniter 17 is connected to the spark plug 16 and the spark plug 16 is actuated by a high voltage applied by the igniter 17. Operation of the igniter 17 is controlled to burn the air-fuel mixture at appropriate timings, thus reciprocating a piston 18. This rotates a crankshaft 19, which is an output shaft of the engine 10. After having been burned, the air-fuel mixture is discharged from the combustion chamber 14 into an exhaust passage 21 as exhaust gas.

The engine 10 also has an exhaust gas recirculation device "hereinafter, referred to as "an EGR device") 22, which introduces some of the exhaust gas from the exhaust passage 21 into the intake passage 11. The EGR device 22 has an EGR passage 23 and an EGR valve 24. The EGR passage 23 connects the exhaust passage 21 to a section of the intake passage 11 downstream of the throttle valve 12. The EGR valve 24 is provided in the EGR passage 23 to variably change the flow passage area of the EGR passage 23 for the exhaust gas. In the present embodiment, the EGR valve 24 is opened and closed by a step motor (not shown). Operational control of the EGR device 22 (hereinafter "EGR control") via operation of the step motor is controlled in accordance with the engine operating state to regulate the opening degree of the EGR valve 24. In this manner, the amount of the exhaust gas introduced into the intake passage 11 via the EGR passage 23 is adjusted.

An automatic transmission 40, which performs gear shifting when the rotational drive force of the engine 10 is output to the wheels as vehicle traveling drive force, is arranged in the vehicle. The automatic transmission 40 has a torque converter 41 and a transmission mechanism 42. The torque converter 41 is configured as a fluid clutch having a pump impeller 41A and a turbine runner 41B. The pump impeller 41A is connected to the crankshaft 19 and the turbine runner 41B is connected to an input shaft 42A of the transmission mechanism 42. The torque converter 41 also includes a lockup mechanism 41C, which mechanically connects the pump impeller 41A and the turbine runner 41B to each other.

An electronic control unit (hereinafter, "an EG-ECU") 30, which has a microcomputer and controls operation of the engine 10, is arranged in the vehicle. Various types of control of the engine 10, such as the throttle opening degree control, the fuel injection control, and the EGR control, are carried out through the EG-ECU 30. Detection signals from various sensors employed in the engine 10, as described below, are input to the EG-ECU 30.

- An engine speed sensor 31 for detecting the rotational speed of the crankshaft 19 (hereinafter "the engine speed NE");
- An intake air amount sensor 32 for detecting the amount of the intake air (hereinafter "the intake air amount") GA passing through the intake passage 11;
- An accelerator pedal operating amount sensor (an accelerator operating amount sensor) 33 for detecting the accelerator pedal operating amount (the accelerator operating amount) ACCP, which is the depression amount of the accelerator pedal;
- A throttle opening degree sensor 34 for detecting the throttle opening degree TA;
- An intake pipe pressure sensor 35 for detecting the pressure of the intake air (hereinafter, "the intake pipe pressure") PIM in a section of the intake passage 11 downstream of the throttle valve 12;
- An air-fuel ratio sensor 36 for detecting the air-fuel ratio A/F of the air-fuel mixture through detection of the oxygen content in the exhaust gas discharged from the combustion chamber 14; and
- A coolant temperature sensor (not shown) for detecting the temperature of the coolant of the engine 10.

The EG-ECU 30 exchanges information with a transmission control unit (hereinafter "an AT-ECU") 50, which controls gear shifting of the automatic transmission 40. The AT-ECU 50 detects the rotational speed NT of the turbine runner 41B from a turbine runner rotational speed sensor 51, which is arranged in the vicinity of the turbine runner 41B of the torque converter 41. The AT-ECU 50 changes the output mode of a command signal to the lockup mechanism 41C to switch the torque converter 41 to either a lockup state or a non-lockup state.

The throttle opening degree control, the fuel injection control, and the EGR control will each hereafter be described.

In the throttle opening degree control, a target throttle opening degree TAtrg is first calculated based on the latest values at the time of the accelerator pedal operating amount ACCP and the engine speed NE. Operation of the throttle motor 13 is then controlled in such a manner that the target throttle opening degree TAtrg and the actual throttle opening degree TA become equal to each other. Through such throttle opening degree control, the amount of the intake air sent into the combustion chamber 14 of the engine 10 is adjusted to an amount corresponding to the engine operating state.

In the fuel injection control, a target fuel injection amount Qtrg (an amount corresponding to the fuel injection amount by which the air-fuel ratio A/F of the air-fuel mixture becomes equal to the target air-fuel ratio A/Ftrg, which is, for example, 14.6) is calculated based on the intake air amount GA and the engine speed NE. The fuel injection valve 15 is then controlled to open in such a manner that the target fuel injection amount Qtrg and the actual fuel injection amount Q become equal to each other.

According to the fuel injection control, fuel cutoff control is performed to suspend fuel injection from the fuel injection valve 15 when a prescribed performing condition is satisfied. Specifically, it is determined that the performing condition is met if the conditions described below are all satisfied:

The accelerator pedal operating amount ACCP is "0";

The engine speed NE has dropped; and

The engine speed NE falls in a predetermined speed range (for example, 1700 to 4000 rpm).

According to the fuel cutoff control, if the engine speed NE becomes lower than or equal to a predetermined resumption engine speed NErtn when the fuel cutoff control is being performed, the fuel cutoff control is suspended and the fuel injection is resumed. The resumption engine speed NErtn is set variably in accordance with the engine operating state. Specifically, the more likely the engine speed NE is lowered as in a case where an auxiliary device is driven, the greater the value of the resumption engine speed NErtn is set.

In the EGR control, a target EGR opening degree is first calculated based on the latest values at the time of the intake air amount GA and the engine speed NE. Operation of the step motor is then controlled in such a manner that the target EGR opening degree and the actual EGR opening degree become equal to each other. Through such EGR control, the EGR amount is adjusted to an amount corresponding to the operating state of the engine 10.

In the present embodiment, abnormality diagnosis control is performed to diagnose whether the EGR device 22 has an abnormality such as malfunction of the EGR valve 24 or clogging of the EGR passage 23. In the abnormality diagnosis control, the EGR valve 24 is opened and closed in a forcible manner on condition that the fuel cutoff control is currently performed. Then, the change amount ΔPIM of the intake pipe pressure caused by opening and closing the EGR valve 24 is determined. Subsequently, it is diagnosed whether the EGR device 22 has an abnormality based on the pressure change amount ΔPIM. When the EGR valve 24 cannot be opened or the EGR passage 23 is clogged, for example, the flow amount of the exhaust gas introduced into the intake passage 11 through the EGR passage 23 is smaller than that in a normal state. In this case, the aforementioned change amount ΔPIM of the intake pipe pressure is smaller than that in a normal state. Accordingly, it is determined that an abnormality has occurred in the EGR device 22 when the pressure change amount ΔPIM is less than a predetermined amount ΔPIMjdg.

Figure 2:
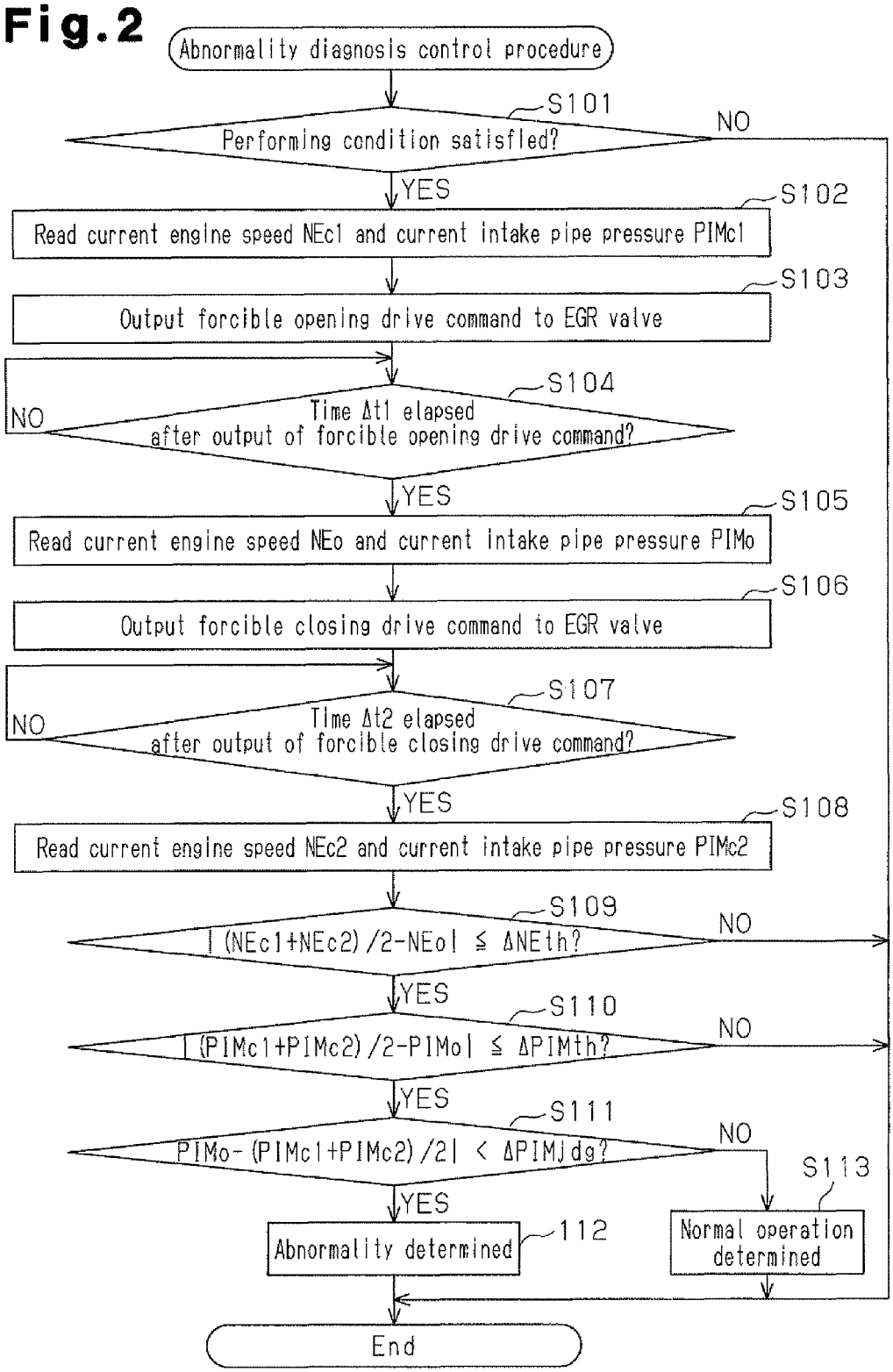
FIG. 2 is a flowchart representing a procedure of abnormality diagnosis control for an EGR device according to the embodiment.

With reference to FIG. 2, the abnormality diagnosis control of the EGR device 22 will hereafter be described in detail with reference to FIG. 2. FIG. 2 is a flowchart representing the procedure of the abnormality diagnosis control. The series of steps represented by the flowchart is repeatedly performed by the EG-ECU 30 when the engine is in operation.

According to the procedure, it is first determined whether a performing condition for the abnormality diagnosis control is satisfied (Step S101). It is determined that the performing condition for the abnormality diagnosis control is met on condition that a predetermined time (which is, herein, several hundreds of milliseconds) has elapsed since the fuel cutoff control was started. If it is determined that the performing condition for the abnormality diagnosis control is not met ("NO" in Step S101), the series of steps is ended.

When it is determined that the performing condition for the abnormality diagnosis control is satisfied in Step S101 ("YES" in Step S101), a current engine speed NEc1 and a current intake pipe pressure PIMc1 are read (Step S102). Specifically, when the abnormality diagnosis control is to be performed, the EGR valve 24 is maintained fully closed as long as the EGR device 22 is normally operating. Accordingly, the engine speed NEc1 and the intake pipe pressure PIMc1 in this state are each read. In the present embodiment, an average of multiple pressure values detected over a predetermined duration (which is, herein, several tens of milliseconds) immediately before reading an intake pipe pressure PIM is read as the intake pipe pressure PIM. Subsequently, an opening drive command is forcibly output to the step motor in order to forcibly open the EGR valve 24 (Step S103).

After the opening drive command has been sent to the EGR valve 24, it is determined whether a predetermined time Δt1 has elapsed since the opening drive command was output (Step S104). Specifically, the predetermined time Δt1 is set as a time (which is, herein, several hundreds of milliseconds) that is sufficiently longer than the time needed for the EGR valve 24 to actually achieve the target opening degree after having received the opening drive command. If a negative determination is made in Step S104 ("NO" in Step S104), the determination of Step S104 is repeatedly performed until a positive determination is made, or until it is determined that the predetermined time Δt1 has elapsed after the opening drive command was output. When the positive determination is made in Step S104 ("YES" in Step S104), a current engine speed NEo and a current intake pipe pressure ΔPIMo are read (Step S105). As long as the EGR device 22 is normally operating, the EGR valve 24 is maintained at the target opening degree, which is opened wider than a fully-closed-state opening degree. Accordingly, the engine speed NEo and the intake pipe pressure PIMo in the state at the target opening degree are each read. Specifically, an average of multiple pressure values detected in a predetermined duration (which is, herein, several tens of milliseconds) immediately before reading the intake pipe pressure PIM is read as the intake pipe pressure PIM. Subsequently, a closing drive command is forcibly output to the EGR valve 24 (Step S106). The closing drive command is a command instructing the EGR valve 24 to switch to a fully closed state.

After the closing drive command has been sent to the EGR valve 24, it is determined whether a predetermined time Δt2 has elapsed since the closing drive command was output (Step S107). Specifically, the predetermined time Δt2 is set as a time (which is, herein, several hundreds of milliseconds) that is sufficiently longer than the time needed for the EGR valve 24 to actually reach the fully closed state after having received the closing drive command. If negative determination is made in Step S107 ("NO" in Step S107), the determination of Step S107 is repeatedly performed until a positive determination is made, or until it is determined that the predetermined time Δt2 has elapsed after the closing drive command was output. When the positive determination is made in Step S107 ("YES" in Step S107), a current engine speed NEc2 and a current intake pipe pressure ΔPIMc2 are read (Step S108). As long as the EGR device 22 is normally operating, the EGR valve 24 is maintained in the fully closed state. Accordingly, the engine speed NEc2 and the intake pipe pressure PIMc2 in the fully closed state are each read. An average of multiple pressure values detected in a predetermined duration (which is, herein, several tens of milliseconds) immediately before reading the intake pipe pressure PIM is read as the intake pipe pressure PIM.

Next, using the expression (1) shown below, it is determined whether the change rate of the engine speed NE at the time when the abnormality diagnosis control is being performed is smaller than or equal to a predetermined value ΔNEth (Step S109).

$$|(NEc1+NEc2)/2-NEo|\leqq\Delta NEth \quad (1)$$

When the change rate of the engine speed NE at the time when the abnormality diagnosis control is being performed is greater than the predetermined value ΔNEth ("NO" in Step S109), it is assumed that the change amount ΔPIM of the intake pipe pressure is influenced by change of the engine speed NE to such a great extent that an erroneous determination may be made. Accordingly, to suspend the abnormality diagnosis control, the series of steps is ended.

If a positive determination is made in Step S109 ("YES" in Step S109), it is then determined whether the change rate of the intake pipe pressure PIM at the time when the abnormality diagnosis control is being performed is smaller than or equal to a predetermined value ΔPIMth (Step S110) using the expression (2) shown below.

$$|(PIMc1+PIMc2)/2-PIMo|\leqq\Delta PIMth \quad (2)$$

When the change rate of the intake pipe pressure PIM at the time when the abnormality diagnosis control is being performed is greater than the predetermined value ΔPIMth ("NO" in Step S110), it is assumed that the change amount ΔPIM of the intake pipe pressure is influenced by factors other than the open/closed state of the EGR valve 24 to such a great extent that an erroneous determination may be made. Accordingly, to suspend the abnormality diagnosis control, the series of steps is ended.

Contrastingly, if a positive determination is made in Step S110 ("YES" in Step S110), Step S111 is carried out. Specifically, using the expression (3) shown below, it is determined whether the value obtained by subtracting the average of the intake pipe pressures PIMc1, PIMc2 at the time when the EGR valve 24 is closed from the intake pipe pressure PIMo at the time when the EGR valve 24 is open is smaller than a predetermined value ΔPIMjdg (Step S111).

$$PIMo-(PIMc1+PIMc2)/2\leqq\Delta PIMjdg \quad (3)$$

Specifically, to reduce the influence on the intake pipe pressure PIM by decrease of the engine speed NE at the time when the abnormality diagnosis control is being performed, the arithmetic mean of the two values PIMc1, PIMc2, which are the values before and after forcible opening of the EGR valve 24, is used as the intake pipe pressure PIM at the time when the EGR valve 24 is closed. In the present embodiment, the predetermined value ΔPIMjdg is set variably in accordance with the engine speed NE or the engine load. If positive determination is made in Step S111 ("YES" in Step S111), it is determined that the EGR device 22 has an abnormality (Step S112) and the series of steps is ended.

Contrastingly, when the determination of Step S111 is negative ("NO" in Step S111), it is determined that the EGR device 22 is operating normally (Step S113) and the series of steps is ended.

Next, with reference to the timing chart of FIG. 3, respective examples of (a) progression of the fuel cutoff control, (b) progression of the abnormality diagnosis control, (c) change of the opening degree of the EGR valve 24, (d) change of the engine speed NE, and (e) change of the intake pipe pressure PIM at the time when the EGR device 22 operates normally will be described. In the item (c) of FIG. 3, the drive commands to the EGR valve 24 and the actual opening degree of the EGR valve 24 are represented by the solid line and the alternate long-and-short dashed line, respectively.

Figure 3:
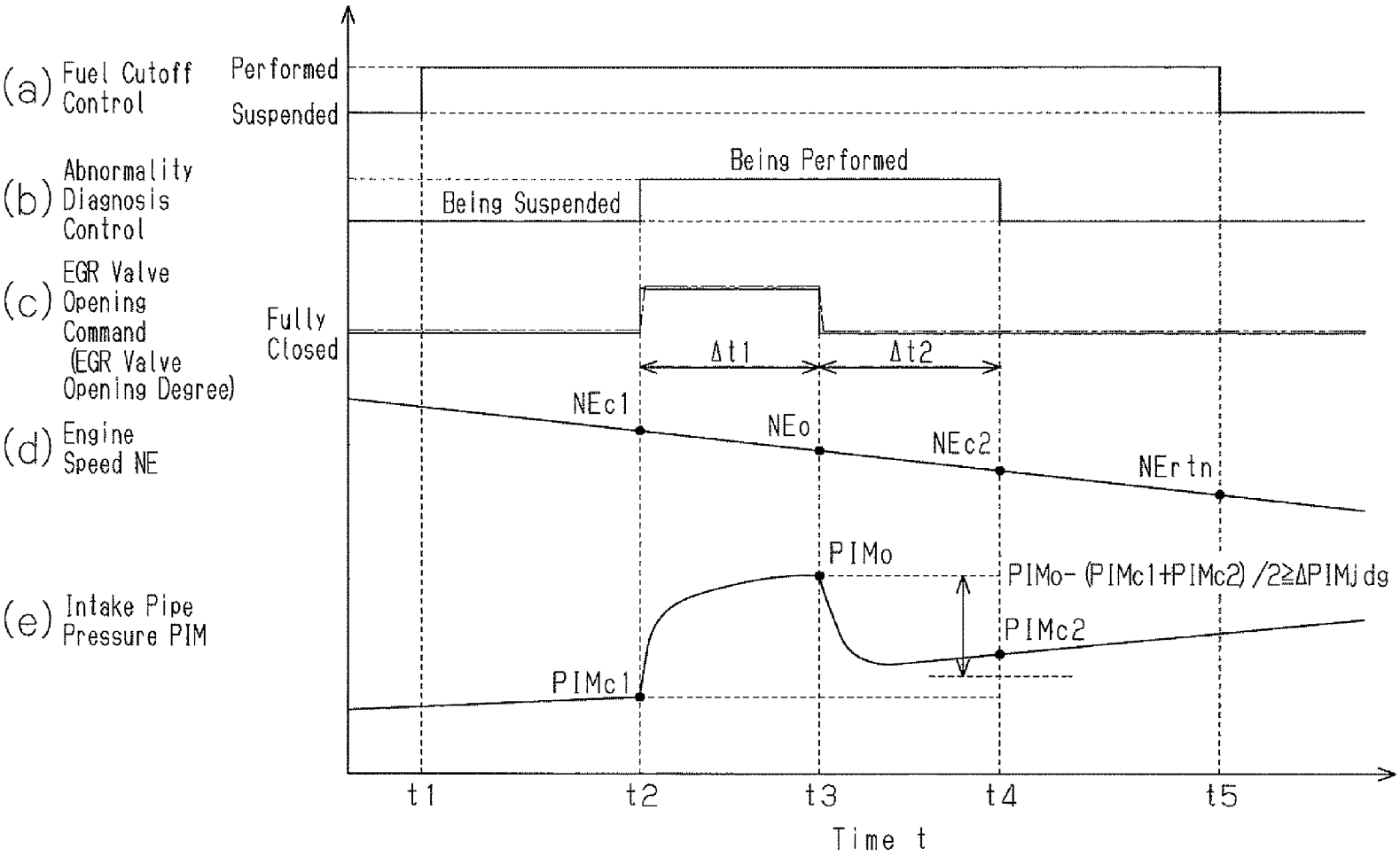
FIG. 3 shows timing charts of execution of the abnormality diagnosis control according to the embodiment, where (a) represents progression of fuel cutoff control, (b) represents progression of the abnormality diagnosis control, (c) represents progression of the opening degree of an EGR valve, (d) represents progression of engine speed, and (e) represents progression of intake pipe pressure.

With reference to FIG. 3, after the fuel cutoff control is started at the time point t1, the abnormality diagnosis control for the EGR device 22 is started at the time point t2, which is the time point after a predetermined time from the time point t1. Accordingly, the engine speed NEc1 at the time point t2 and the average PIMc1 of the multiple intake pipe pressures detected in the predetermined duration immediately before the time point t2 are each read. Then, to forcibly drive the EGR valve 24 to open from the fully closed state, the drive command is output to the EGR valve 24 as indicated by the solid lines in (c). Correspondingly, as indicated by the alternate long-and-short dashed lines in (c), the actual opening degree of the EGR valve 24 is changed to the target opening degree, which is opened wider than the opening degree of the fully closed state.

Subsequently, at the time point t3, which is after the predetermined time Δt1 from the time point t2, the current engine speed NEo and the average PIMo of the intake pipe pressures detected in the predetermined duration immediately before the time point t3 are each read. Then, to forcibly drive the EGR valve 24 to close, the drive command is output to the EGR valve 24 as indicated by the solid lines in (c). Correspondingly, as indicated by the alternate long-and-short dashed lines in (c), the actual opening degree of the EGR valve 24 is changed to the fully-closed-state opening degree.

Then, at the time point t4, which is after the predetermined time Δt2 from the time point t3, the current engine speed NEc2 and the average PIMc2 of the intake pipe pressures detected in the predetermined duration immediately before the time point t4 are each read. If the value obtained by subtracting the average of the intake pipe pressures PTMc1, PIMc2 obtained at the time points t2, t4, respectively, from the intake pipe pressure PIMo obtained at the time point t3 is greater than or equal to the predetermined value ΔPIMjdg, it is determined that the EGR device 22 operates normally. This determination ends the abnormality diagnosis control for the EGR device 22. Afterwards, when the engine speed NE becomes lower than or equal to the resumption engine speed NErtn at the time point t5, the fuel cutoff control is ended.

As has been described, there may be cases in which, after the engine speed NE has become lower than the resumption engine speed NErtn, the abnormality diagnosis control for the EGR device 22 remains incomplete and the EGR valve 24 is held open. In this case, the exhaust gas is introduced into the intake passage 11 through the EGR passage 23. This may degrade the combustion performance of the engine and excessively decrease the engine speed NE.

To solve these problems, in the present embodiment, a predetermined forcible suspension engine speed NEoff (≧NErtn), which is an engine speed greater than or equal to the resumption engine speed NErtn, is set. If the engine speed NE falls below the forcible suspension engine speed NEoff when the diagnosis control is being carried out, the EGR valve 24 is forcibly closed and the diagnosis control is suspended. Also, the resumption engine speed NErtn is set variably in accordance with the engine operating state. Accordingly, to prevent the engine speed NE from excessively dropping even when the resumption engine speed NErtn is set to its maximum value, the forcible suspension engine speed NEoff is set to the value greater than or equal to the maximum value of the resumption engine speed NErtn. This prevents degradation of the engine combustion performance caused by the EGR valve 24 that is maintained open even after the fuel cutoff control is suspended.

However, if the forcible suspension engine speed NEoff is set to a comparatively great fixed value, the engine speed NE often falls below the forcible suspension engine speed NEoff when the abnormality diagnosis control for the EGR device 22 is being performed. This decreases the frequency that the diagnosis control is completed. In contrast, if the forcible suspension engine speed NEoff is set to a comparatively small fixed value, there may be cases in which the forcible suspension engine speed NEoff falls below the resumption engine speed NErtn in certain engine operating states. In these cases, excessive decrease of the engine speed NE after the fuel cutoff control is suspended cannot be avoided.

To prevent such disadvantage, in the present embodiment, the forcible suspension engine speed NEoff is updated at predetermined cycles in accordance with the open/closed state of the EGR valve 24 through the EG-ECU 30 when the abnormality diagnosis control of the EGR device 22 is being performed. Specifically, the forcible suspension engine speed NEoff has a smaller value when the EGR valve 24 is not in a forcibly opened state than when the EGR valve 24 is in the forcibly opened state. More specifically, the forcible suspension engine speed NEoff is set in such a manner that an allowance ΔNEallw of the forcible suspension engine speed NEoff with respect to the resumption engine speed NErtn has a smaller value when the EGR valve 24 is not in the forcibly opened state than when the EGR valve 24 is in the forcibly opened state. The "allowance ΔNEallw" indicates the increase amount (including "zero") of the forcible suspension engine speed NEoff with respect to the resumption engine speed NErtn and corresponds to the difference between the forcible suspension engine speed NEoff to be set and the resumption engine speed NErtn.

When the abnormality diagnosis control is being carried out and the EGR valve 24 is not in the forcibly opened state, the exhaust gas is not introduced into the intake passage 11 through the EGR passage 23. Accordingly, compared to when the EGR valve 24 is in the forcibly opened state, excessive decrease of the engine speed NE caused by the exhaust gas introduced into the intake passage 11 through the EGR passage 23 is less likely to happen even if the abnormality diagnosis control is continued until the engine speed NE decreases to a lower value. Accordingly, by setting the forcible suspension engine speed NEoff to smaller value when the EGR valve 24 is not in the forcibly opened state than when the EGR valve 24 is in the forcibly opened state, the abnormality diagnosis control is continuously performed without causing a problem until the engine speed NE becomes a lower value, compared to, for example, the configuration including the forcible suspension engine speed NEoff set to the comparatively great fixed value. Further, the forcible suspension engine speed NEoff is set to a value greater than or equal to the resumption engine speed NErtn. This prevents excessive decrease of the engine speed NE caused by the forcible suspension engine speed NEoff that is variably set. As a result, the excessive decrease of the engine speed NE is prevented and the frequency that the abnormality diagnosis control for the EGR device 22 is completed is increased.

Figure 4:
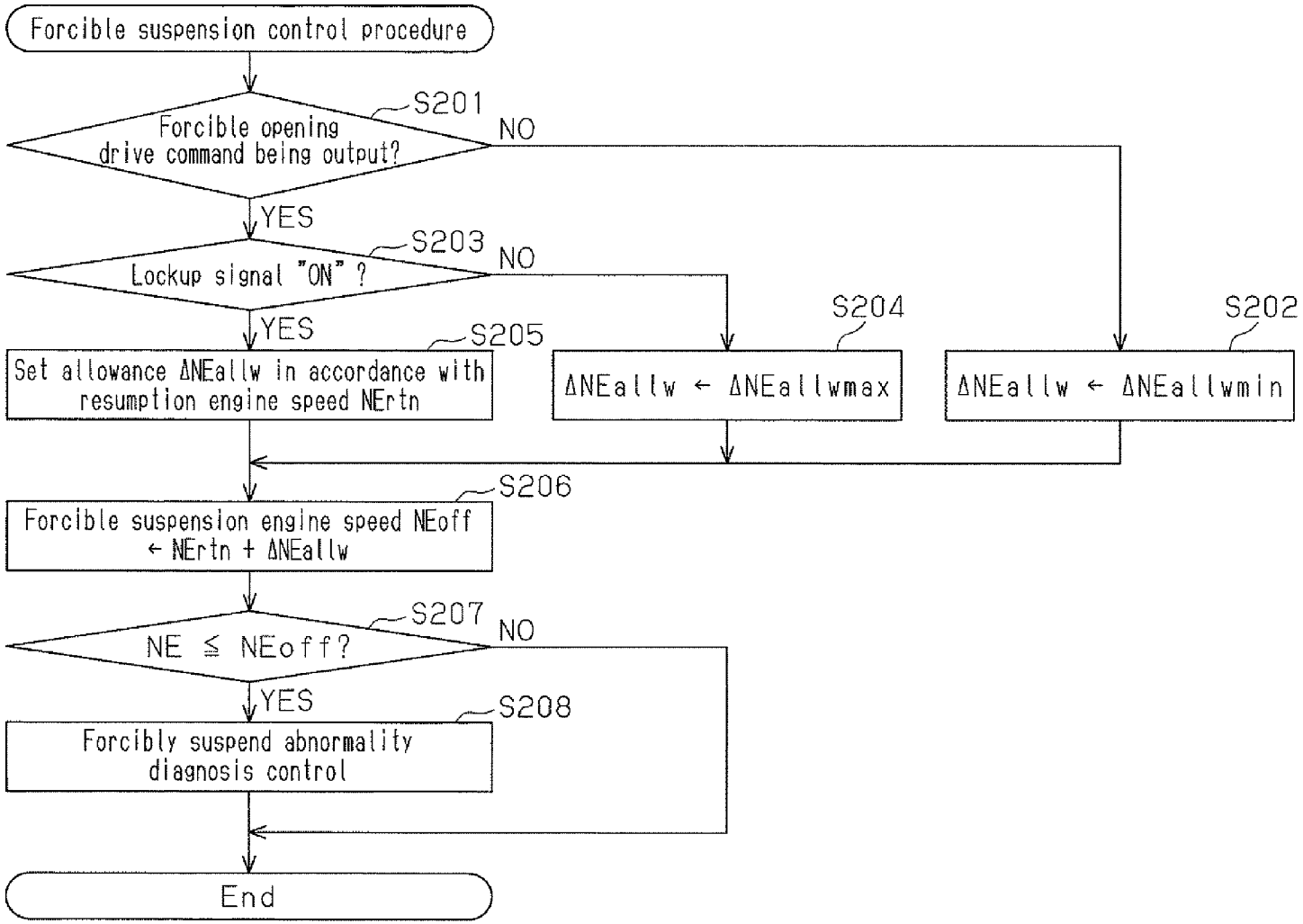
FIG. 4 is a flowchart representing a procedure of forcible suspension control according to the embodiment.

Next, the procedure of the forcible suspension control for forcibly suspending the abnormality diagnosis control will be described in detail with reference to FIG. 4. FIG. 4 is a flowchart representing the procedure steps of the forcible suspension control. The series of steps represented by the flowchart is repeatedly performed at predetermined cycles through the EG-ECU 30 when the abnormality diagnosis control is being carried out.

As represented by FIG. 4, in the procedure, it is determined whether the forcible opening drive command has been output to the EGR valve 24 (Step S201). If the forcible opening drive command has not been output ("NO" in Step S201), the allowance ΔNEallw is set to its minimum value ΔNEallwmin (Step S202). In the present embodiment, the minimum value ΔNEallwmin of the allowance is "0".

If it is determined that the forcible opening drive command has been output in the determination of Step S201 ("YES" in Step S201), it is then determined whether a command signal instructing the lockup mechanism 41C to switch the torque converter 41 to a lockup state (hereinafter, "a lockup command signal") has been output from the AT-ECU 50 (Step S203). When it is determined that the lockup command signal has not been output from the AT-ECU 50 in Step S203 ("NO" in Step S203), the allowance ΔNEallw is set to the maximum value ΔNEallwmax (Step S204). Specifically, the allowance ΔNEallw is set to the maximum value ΔNEallwmax for the reason described below. That is, when the abnormality diagnosis control is being performed and the EGR valve 24 is in the forcibly opened state, the extent of expected decrease of the engine speed NE is greater when the torque converter 41 is not in the lockup state than when the torque converter 41 is in the lockup state.

In contrast, when the lockup command signal has been output from the AT-ECU 50 ("YES" in Step S203), the allowance ΔNEallw is set variably in accordance with the current resumption engine speed NErtn (Step S205). Specifically, the allowance ΔNEallw is set to a lower value as the resumption engine speed NErtn becomes greater. The reason for setting the allowance ΔNEallw variably in accordance with the current resumption engine speed NErtn will now be described. That is, when the engine operating state is such that the engine speed NE easily drops, the resumption engine speed NErtn is set to a great value with allowance. Such setting prevents excessive decrease of the engine speed NE, even if the forcible suspension engine speed NEoff is set in such a manner as to decrease the allowance ΔNEallw for the resumption engine speed NErtn.

As has been described, the EG-ECU 30 changes the forcible suspension engine speed NEoff depending on whether the torque converter 41 is in the lockup state or the non-lockup state when the EGR valve 24 is in the forcibly opened state. In other words, the EG-ECU 30 sets the forcible suspension engine speed NEoff to a greater value when the torque converter 41 is not in the lockup state than when the torque converter 41 is in the lockup state.

After setting the allowance ΔNEallw in any of Steps S202, S204, and S205, the forcible suspension engine speed NEoff is calculated by adding the allowance ΔNEallw to the resumption engine speed NErtn in accordance with the expression (4) below (Step S206).

$$NEoff \leftarrow NErtn + \Delta NEallw \quad (4)$$

Subsequently, it is determined whether the current engine speed NE is lower than or equal to the forcible suspension engine speed NEoff (Step S207). When the engine speed NE is lower than or equal to the forcible suspension engine speed NEoff ("YES" in Step S207), the abnormality diagnosis control is forcibly suspended (Step S208) and the series of steps is suspended. Specifically, if the EGR valve 24 is open, the EGR valve 24 is forcibly closed and the abnormality diagnosis control is suspended. If the EGR valve 24 is closed and determination is not carried out, the diagnosis control is suspended.

Contrastingly, when the engine speed NE is greater than the forcible suspension engine speed NEoff ("NO" in Step S207), the series of steps is suspended without performing Step S208, or, in other words, without forcibly suspending the abnormality diagnosis control.

Figure 5:
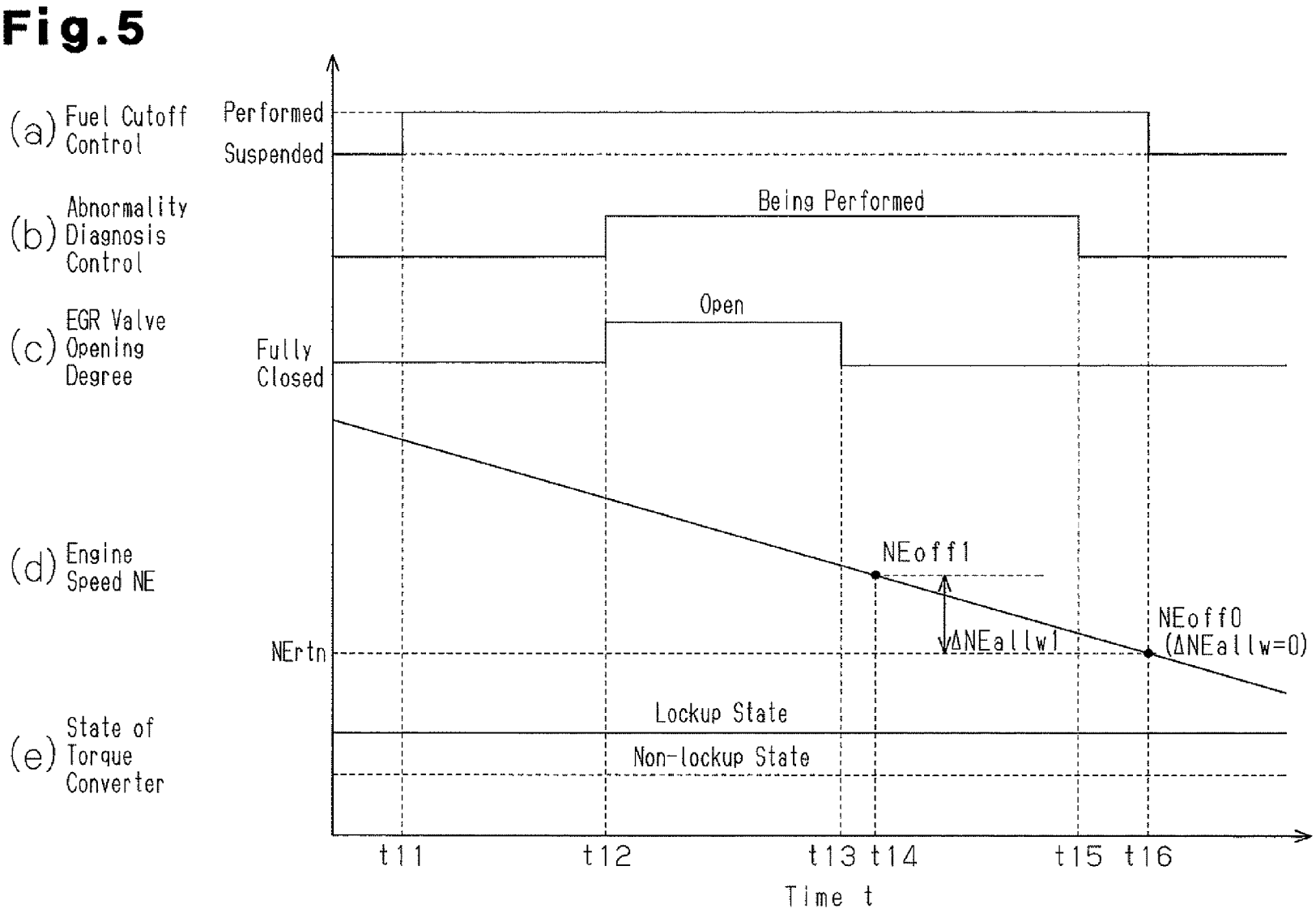
FIG. 5 shows timing charts of the execution of the abnormality diagnosis control and forcible suspension control according to the embodiment, where (a) represents progression of fuel cutoff control, (b) represents progression of the abnormality diagnosis control, (c) represents progression of the opening degree of an EGR valve, (d) represents progression of engine speed, and (e) represents progression of the state of a torque converter.
Figure 6:
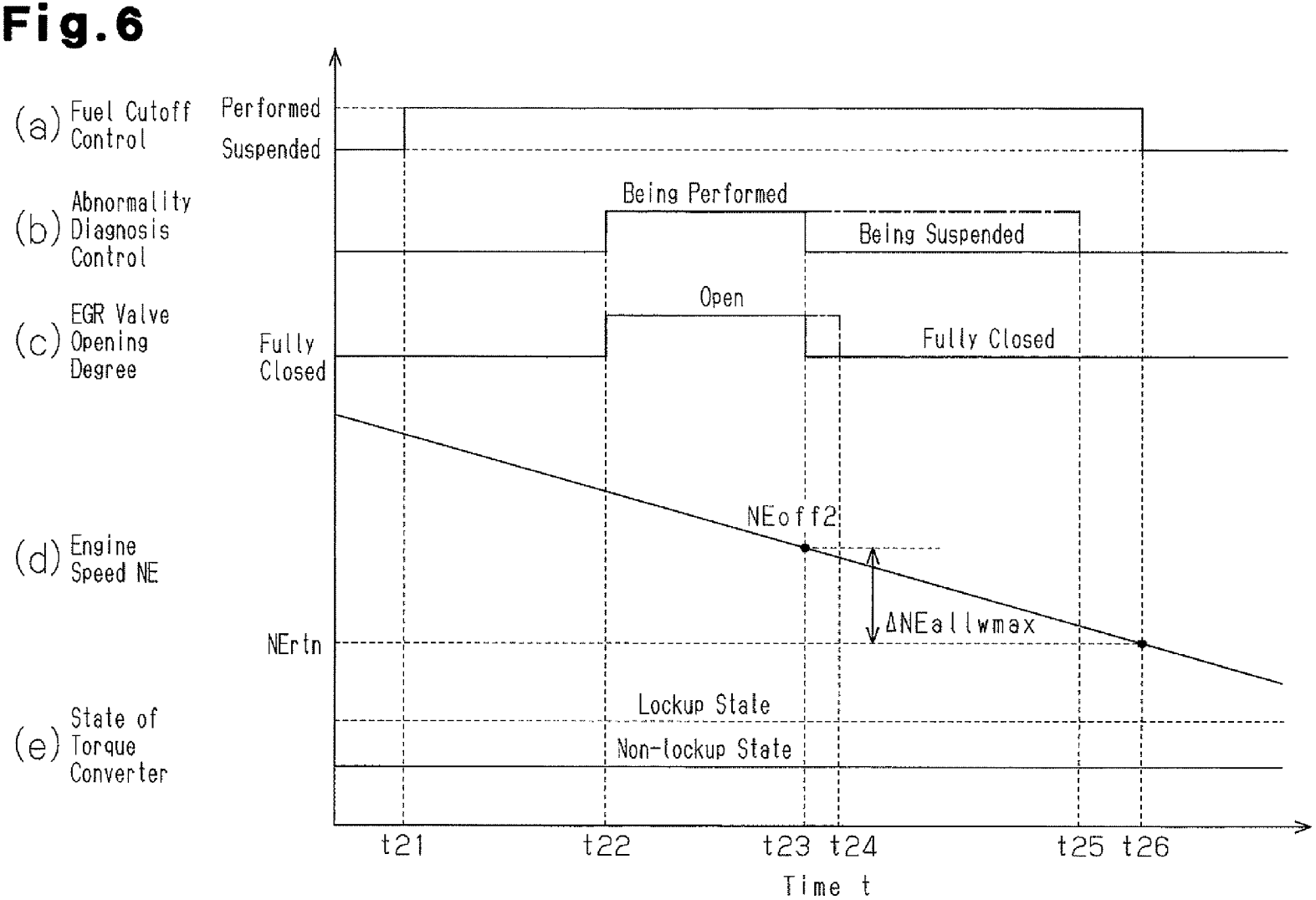
FIG. 6 show timing charts of the execution of the abnormality diagnosis control and forcible suspension control according to the embodiment, where (a) represents progression of fuel cutoff control, (b) represents progression of the abnormality diagnosis control, (c) represents progression of the opening degree of an EGR valve, (d) represents progression of engine speed, and (e) represents progression of the state of a torque converter.

The description below, with reference to the timing charts of FIGS. 5 and 6, is of respective examples of (a) progression of the fuel cutoff control, (b) progression of the abnormality diagnosis control, (c) change of the opening degree of the EGR valve 24, (d) change of the engine speed NE, and (e) change of the state of the torque converter 41 at the time when the abnormality diagnosis control for the EGR device 22 and the forcible suspension control for the abnormality diagnosis control are performed.

FIG. 5 shows an example of a case in which, when the abnormality diagnosis control is being performed, the engine speed NE does not fall below a forcible suspension engine speed NEoff1, which is set in the period during which the EGR valve 24 is open so long as the EGR valve 24 is open. FIG. 6 shows an example of a case in which, when the abnormality diagnosis control is being performed, the engine speed NE falls below a forcible suspension engine speed NEoff2, which is set in the period during which the EGR valve 24 is open in the aforementioned period. The timing charts are based on the assumption that the EGR device 22 operates normally.

First, as indicated by FIG. 5, after the fuel cutoff control is started at the time point t11, the abnormality diagnosis control for the EGR device 22 is started at the time point t12 and the EGR valve 24 is forcibly opened. After the time point t12, as long as the EGR valve 24 is maintained open, the forcible suspension engine speed NEoff is set based on the state of the torque converter 41. In the example shown in FIG. 5, the torque converter 41 is held in the lockup state in the period in which the EGR valve 24 is open. Accordingly, the forcible suspension engine speed NEoff is set to the value NEoff1, which is obtained by adding an allowance ΔNEallw1 set in accordance with the current resumption engine speed NErtn, to the resumption engine speed NErtn. In this case, as long as the EGR valve 24 is open (from the time point t12 to the time point t13), the engine speed NE does not fall below the aforementioned forcible suspension engine speed NEoff1. Accordingly, after the time point t13 at which the EGR valve 24 is closed, the forcible suspension engine speed NEoff is set to the comparatively small value that is equal to the resumption engine speed NErtn (NEoff0=NErtn). Then, the abnormality diagnosis control is completed at the time point t15 at which the engine speed NE is greater than the forcible suspension engine speed NEoff (=resumption engine speed NErtn). Afterwards, when the engine speed NE becomes equal to the resumption engine speed NErtn at the time point t16, the fuel cutoff control is suspended.

Next, as represented by FIG. 6, after the fuel cutoff control is started at the time point t21, the abnormality diagnosis control for the EGR device 22 is started at the time point t22 and the EGR valve 24 is forcibly opened. After the time point t22, as long as the EGR valve 24 is maintained open, the forcible suspension engine speed NEoff is set in accordance with the state of the torque converter 41. In the example of FIG. 6, the torque converter 41 is not in the lockup state (is in the non-lockup state) in the period during which the EGR valve 24 is open. Accordingly, the forcible suspension engine speed NEoff is set to the value NEoff2 (NEoff2>NEoff1>NErtn), which is obtained by adding the maximum value ΔNEallwmax of the allowance to the current resumption engine speed NErtn. In other words, the forcible suspension engine speed NEoff is set to a greater value than when the torque converter 41 is in the lockup state. In this case, at the time point t23 in the period in which the EGR valve 24 is maintained open, the engine speed NE falls below the aforementioned forcible suspension engine speed NEoff2. This forcibly closes the EGR valve 24 and forcibly suspends the abnormality diagnosis control for the EGR device 22.

In FIG. 6, the progression of the abnormality diagnosis control and the change of the opening degree of the EGR valve 24 in a case in which the abnormality diagnosis control is continued after the time point 23 are indicated by the alternate long-and-short dashed lines. When the abnormality diagnosis control is continued in this manner, the EGR valve 24 is maintained open in the period from the time point t23 to the time point t24. This introduces the exhaust gas into the intake passage 11 through the EGR passage 23. As a result, the engine speed NE may excessively fall after the time point t26 at which the fuel cutoff control is suspended and the fuel injection is restarted.

The control device for the internal combustion engine according to the present embodiment has the advantages described below.

(1) During the abnormality diagnosis for the EGR device 22, the forcible suspension engine speed NEoff has a lower value when the EGR valve 24 is not in the forcibly opened state than when the EGR valve 24 is in the forcibly opened state. Specifically, when the abnormality diagnosis for the EGR device 22 is being carried out, the EG-ECU 30 updates the forcible suspension engine speed NEoff at predetermined cycles in accordance with the current open/closed state of the EGR valve 24. The forcible suspension engine speed NEoff is set in such a manner that the allowance ΔNEallw of the forcible suspension engine speed NEoff with respect to the resumption engine speed NErtn has a small value when the EGR valve 24 is not in the forcibly opened state than when the EGR valve 24 is in the forcibly opened state. As a result, the abnormality diagnosis control is continued until the engine speed NE becomes a lower value than that when the forcible suspension engine speed NEoff is set to a comparatively great fixed value. This decreases the frequency that the abnormality diagnosis control is forcibly suspended due to the engine speed NE becoming lower than or equal to the forcible suspension engine speed NEoff when the abnormality diagnosis control is being performed. Further, the forcible suspension engine speed NEoff is set to a value that is equal to or greater than the resumption engine speed NErtn. This prevents excessive decrease of the engine speed NE caused by the forcible suspension engine speed NEoff that is variably set. As a result, excessive decrease of the engine speed NE is prevented and the frequency of cases in which the abnormality diagnosis control for the EGR device 22 is completed is increased.

(2) When the command signal instructing the torque converter 41 to switch to the lockup state is not output from the AT-ECU 50, the EG-ECU 30 sets the forcible suspension engine speed NEoff with the allowance ΔNEallw with respect to the resumption engine speed NErtn set to the maximum value ΔNEallwmax. This reliably prevents excessive decrease of the engine speed NE.

(3) When the command signal instructing the torque converter 41 to switch to the lockup state is output from the AT-ECU 50, the EG-ECU 30 sets the forcible suspension engine speed NEoff in such a manner that the greater the resumption engine speed NErtn, the lower the allowance ΔNEallw of the forcible suspension engine speed NEoff with respect to the resumption engine speed NErtn. As a result, the forcible suspension engine speed NEoff is adequately set in accordance with the resumption engine speed NErtn. This reliably prevents excessive decrease of the engine speed NE.

(4) When the EGR valve 24 is not in the forcibly opened state, the EG-ECU 30 sets the forcible suspension engine speed NEoff to the value equal to the resumption engine speed NErtn. Accordingly, since the forcible suspension engine speed NEoff is equal to the resumption engine speed NErtn (NEoff=NErtn), the frequency of forcible suspension of the diagnosis caused by the engine speed NE that becomes lower than or equal to the forcible suspension engine speed NEoff when the diagnosis is performed is further decreased.

(5) The EG-ECU 30 uses the average of the pressure values detected in the predetermined period as the intake pipe pressure PIM. This decreases the influence by fluctuation of the intake pipe pressure PIM, thus improving accuracy of the diagnosis. In this case, the time needed for completion of the diagnosis is prolonged and the frequency of the forcible suspension of the diagnosis caused by the engine speed NE that becomes lower than or equal to the forcible suspension engine speed NEoff is increased. However, the present embodiment prevents excessive decrease of the engine speed NE and increases the frequency in which the diagnosis is completed of whether the EGR device 22 has an abnormality.

(6) The EG-ECU 30 sets the forcible suspension engine speed NEoff only when the abnormality diagnosis for the EGR device 22 is being carried out. In this manner, setting of the forcible suspension engine speed NEoff is performed only when necessary. This prevents increase of calculation load on the EG-ECU 30 and the AT-ECU 50.

The control device of the internal combustion engine is not restricted to the configuration illustrated for the above-described embodiment but may be embodied in forms modified from the configuration as necessary, such as the forms described below.

The above embodiment has been illustrated for an EGR valve 24 that is driven by a step motor. However, an EGR valve according to the present invention is not restricted to this EGR valve 24 but may be an EGR valve that is driven by a motor other than a step motor. That is, any suitable EGR valve may be employed as long as the EGR valve is arranged in the EGR passage 23 and varies the flow passage area of the exhaust gas.

In the above illustrated embodiment, the forcible suspension engine speed NEoff is set through the EG-ECU 30 only when the abnormality diagnosis for the EGR device 22 is being carried out. However, setting of the forcible suspension engine speed NEoff may be constantly performed as long as the engine operates, unless the increased calculation load of the EG-ECU 30 and the AT-ECU 50 reaches a disadvantageous level.

In the above illustrated embodiment, it is determined whether the change rate of the intake pipe pressure PIM in the abnormality diagnosis control is greater than the predetermined value ΔPIMth using the expression (2). When the change rate is greater than the predetermined value ΔPIMth, it is assumed that the change amount ΔPIM of the intake pipe pressure is influenced by factors other than the open/closed state of the EGR valve 24 to such a great extent that an erroneous determination may be made. Accordingly, the abnormality diagnosis control is suspended in this case. The means for determining the change rate of the intake pipe pressure PIM in the abnormality diagnosis control, however, is not restricted to the expression (2). That is, the expression may be modified as needed as long as the change rate is reliably determined by the expression.

In the above illustrated embodiment, it is determined, using the expression (1), whether the change rate of the engine speed NE in the abnormality diagnosis control exceeds the predetermined value ΔNEth. When the change rate is greater than the predetermined value ΔNEth, change of the engine rate NE influences the change amount ΔPIM of the intake pipe pressure to such a great extent that an erroneous determination may be made. Accordingly, the abnormality diagnosis control is suspended in this case. The means for determining the change rate of the engine speed NE in the abnormality diagnosis control, however, is not restricted to the expression (1). That is, the expression may be modified as needed as long as the change rate is reliably determined by the expression.

In the above illustrated embodiment, to prevent influence on the intake pipe pressure PIM by decrease of the engine speed NE at the time when the abnormality diagnosis control is being performed, the pressure value determined by the above-cited expression (3), which is the arithmetic mean of the two values PIMc1, PIMc2 obtained before and after the forcible valve opening, is used as the intake pipe pressure PIM at the time when the EGR valve is closed. However, if the influence on the intake pipe pressure PIM by the decrease of the engine speed NE at the time when the abnormality diagnosis control is being carried out can be ignored, either one of the values before and after the forcible valve opening may be used as the intake pipe pressure PIM at the time when the EGR valve is closed. In other words, the diagnosis means (or the diagnosis section) according to the present invention does not necessarily have to have the configuration of this expression (3).

As in the above illustrated embodiment, to decrease the influence by fluctuation of the intake pipe pressure PIM and improve accuracy of the diagnosis, it is preferable to use the average of the multiple detection results obtained in the predetermined period as the intake pipe pressure PIM in the abnormality diagnosis control for the EGR device 22. However, if the influence by the fluctuation of the intake pipe pressure PIM can be ignored, a single detection result may be used as the intake pipe pressure PIM.

In the above illustrated embodiment, determination of whether the EGR device 22 has an abnormality is based on the difference between the intake pipe pressure at the time when the EGR valve is closed and the intake pipe pressure at the time when the EGR valve is open. However, the diagnosis means (or the diagnosis section) according to the present invention is not restricted to this. That is, the determination of whether there is abnormality in the EGR device 22 may be made based on the ratio between the intake pipe pressure PIM at the time when the EGR valve is closed and the intake pipe pressure at the time when the EGR valve is open.

In other words, any suitable diagnosis means (or section) may be employed as long as the means (the section) forcibly opens and closes the EGR valve when the fuel cutoff control is being performed and ensures determination whether the EGR device 22 has an abnormality based on the extent of the pressure change in the intake passage caused by such opening and closing of the valve.

In the above illustrated embodiment, the EGR valve is forcibly opened from the fully closed state in the abnormality diagnosis control for the EGR device 22. However, the diagnosis means (or the diagnosis section) is not restricted to this but may be a type that forcibly opens the EGR valve from a predetermined angle opened wider than the fully closed state. In other words, any suitable diagnosis means (or section) may be employed as long as the means (the section) forcibly opens and closes the EGR valve 24.

In the above illustrated embodiment, in the forcible suspension control of the abnormality diagnosis control, the forcible suspension engine speed NEoff is set to the value equal to the resumption engine speed NErtn when the EGR valve is not in the forcibly opened state. In other words, the allowance ΔNEallw of the forcible suspension engine speed NEoff with respect to the resumption engine speed NErtn is set to "0". However, the forcible suspension means (or the forcible suspension section) according to the present invention is not restricted to this. That is, as long as the allowance ΔNEallw is smaller than that when the EGR valve 24 is in the forcibly opened state, or, in other words, the forcible suspension engine speed NEoff is smaller than that when the EGR valve 24 is in the forcibly opened state, the allowance ΔNEallw may be set to a value greater than "0". That is, the forcible suspension engine speed NEoff may be set to a value greater than the resumption engine speed NErtn.

In the above illustrated embodiment, it is determined that the torque converter 41 is in the lockup state if the lockup command signal has been output from the AT-ECU 50. However, even when the lockup command signal has been output from the AT-ECU 50, there may be cases, though less likely, in which the pump impeller 41A and the turbine runner 41B are not actually mechanically connected to each other, or, in other words, the lockup state has not been brought about. Accordingly, by determining that the torque converter 41 is in the lockup state when the lockup command signal has been output from the AT-ECU 50 and the absolute value of the difference between the rotation speed NT of the turbine runner 41B and the engine speed NE is less than a predetermined value ΔNrck, determination whether the torque converter 41 is in the lockup state is accomplished reliably. In this case, if the lockup command signal has been output from the AT-ECU 50 but the absolute value of the difference between the turbine runner rotation speed NT and the engine speed NE is greater than or equal to the predetermined value ΔNrck, the allowance ΔNEallw may be set to the maximum value ΔNEallwmax, considering that it is likely that the lockup state has not actually been brought about. In this manner, the forcible suspension engine speed NEoff is adequately set in accordance with the actual state of the torque converter 41.

As has been described, it is determined that the torque converter 41 is in the lockup state when the absolute value of the difference between the rotation speed NT of the turbine runner 41B and the engine speed NE is less than the predetermined value ΔNrck. However, the forcible suspension means (or the forcible suspension section) according to the present invention is not restricted to this. That is, it may be determined that the torque converter 41 is in the lockup state when the ratio between the rotation speed NT of the turbine runner 41B and the engine speed NE is less than a predetermined value. In other words, the determination may be made in any suitable manner as long as it is determined that the torque converter 41 is in the lockup state when the rotation speed NT of the turbine runner 41B and the engine speed NE differ from each other to an extent less than a predetermined extent.

In the above illustrated embodiment, if it is determined, in the forcible suspension control of the abnormality diagnosis control, that the torque converter 41 is in the lockup state when the EGR valve is in the forcibly opened state, the forcible suspension engine speed NEoff is set in such a manner that the greater the resumption rotation speed NErtn becomes, the smaller the allowance ΔNEallw with respect to the resumption engine speed NErtn becomes. However, the forcible suspension means (or the forcible suspension section) according to the present invention is not restricted to this. That is, the allowance ΔNEallw may be set to a fixed value regardless of the resumption engine speed NErtn. In this case, to prevent excessive decrease of the engine speed NE, it is preferable to set the allowance ΔNEallw to a value that is great to a certain extent for cases in which the resumption engine speed NErtn is small.

In the above illustrated embodiment, if the command signal instructing the torque converter 41 to switch to the lockup state has not been output from the AT-ECU 50 when the EGR valve is in the forcibly opened state, the forcible suspension engine speed NEoff is set with the allowance ΔNEallw with respect to the resumption engine speed NErtn set to the maximum value ΔNEallwmax. However, the forcible suspension means (the forcible suspension section) according to the present invention is not restricted to this. That is, the aforementioned allowance ΔNEallw and the aforementioned forcible suspension engine speed NEoff may be set based on the extent to which the rotation speed NT of the turbine runner 41B and the engine speed NE differ from each other, regardless of whether the command signal instructing switching of the torque converter 41 to the lockup state has been output. In other words, although the above illustrated embodiment has been described for the torque converter 41 having the lockup mechanism 410, the present invention may be used in a torque converter that does not include the lockup mechanism 410. In this case, when the rotation speed NT of the turbine runner 41B and the engine speed. NE differ from each other to an extent not less than a predetermined extent, it may be assumed that the engine speed NE will later drop to a great extent. Accordingly, in this case, the forcible suspension engine speed NEoff may be set with the allowance ΔNEallw with respect to the resumption engine speed NErtn set to the maximum value ΔNEallwmax.

Although the above illustrated embodiment has been described for the automatic transmission 40 including a torque converter, which is a fluid clutch, the clutch according to the present invention is not restricted to this. Any other suitable clutch such as a friction clutch may be employed as long as the clutch ensures power transmission between the internal combustion engine 10 and the transmission. Also in this case, like the case with the torque converter, the forcible suspension engine speed NEoff may be set when the EGR valve is in the forcible open state, in such a manner that the allowance ΔNEallw with respect to the resumption engine speed NErtn is se to a greater value when the rotation speed of the output shaft of the clutch and the engine speed NE differ from each other to a great extent than when such extent is small. Alternatively, the allowance ΔNEallw may be set to a fixed value regardless of the resumption engine speed NErtn. In this case, to prevent excessive decrease of the engine speed NE, it is preferable to set the allowance ΔNEallw to a value that is great to a certain extent for cases in which the resumption engine speed NErtn is small.

To prevent excessive decrease of the engine speed NE and increase the frequency of cases in which the abnormality diagnosis for the EGR device 22 is completed, it is preferable to set the forcible suspension engine speed NEoff in such a manner that the greater the resumption engine speed NErtn, the smaller the allowance ΔNEallw with respect to the resumption engine speed NErtn, as in the case of the present embodiment. However, the forcible suspension means (or the forcible suspension section) according to the present invention is not restricted to this. That is, the allowance ΔNEallw and the forcible suspension engine speed NEoff may be set to fixed values regardless of the resumption engine speed NErtn.

In the above illustrated embodiment, the resumption engine speed NErtn is set variably in accordance with the operating state of the auxiliary device of the engine. However, the fuel cutoff control means (or the fuel cutoff control section) according to the present invention is not restricted to this. That is, the resumption engine speed NErtn may be set variably in accordance with an engine operating state other than the operating state of the engine auxiliary device.

In the above illustrated embodiment, the resumption engine speed NErtn is variably set in accordance with the engine operating state. However, the fuel cutoff control means (or the fuel cutoff control section) according to the present invention is not restricted to this. That is, the resumption engine speed NErtn may be set to a fixed value regardless of the engine operating state. Even in this case, the present invention may be used. In other words, any suitable fuel cutoff control means (section) may be employed as long as the means (section) performs fuel cutoff control by which fuel supply to the engine 10 is blocked, and suspends the fuel cutoff control on condition that the engine speed NE becomes lower than or equal to a predetermined resumption engine speed NErtn when the fuel cutoff control is being carried out.

Ultimately, the present invention may be configured in any suitable manner as long as the configuration includes forcible suspension means (or a forcible suspension section) that sets the forcible suspension engine speed to a smaller value when the EGR valve is not in the forcibly opened state than when the EGR valve is in the forcibly opened state. In other words, the invention may be configured in any suitable manner as long as the configuration includes forcible suspension means (or a forcible suspension section) that, when diagnosis means (or a diagnosis section) performs diagnosis, updates the forcible suspension engine speed at predetermined cycles in accordance with the current open/closed state of the EGR valve, and sets the forcible suspension engine speed in such a manner that the allowance with respect to the resumption engine speed has a smaller value when the EGR valve is not in the forcibly opened state than when the EGR valve is in the forcibly opened state.

Description of the Reference Numerals

10 . . . Internal Combustion Engine, 11 . . . Intake Passage, 12 . . . Throttle Valve, 13 . . . Throttle Motor, 14 . . . Combustion Chamber, 15 . . . Fuel Injection Valve, 16 . . . Spark Plug, 17 . . . Igniter, 18 . . . Piston, 19 . . . Crankshaft, 21 . . . Exhaust Passage, 22 . . . EGR Device, 23 . . . EGR Passage, 24 . . . EGR Valve, 30 . . . EG-ECU (Control Device), 31 . . . Engine Speed Sensor, 32 . . . Intake Air Amount Sensor, 33 . . . Accelerator Sensor, 34 . . . Throttle Sensor, 35 . . . Intake Pipe Pressure Sensor, 36 . . . Air-Fuel Ratio Sensor, 40 . . . Automatic Transmission, 41 . . . Torque Converter, 41A . . . Pump Impeller, 41B . . . Turbine Runner, 41C . . . Lockup Mechanism, 42 . . . Transmission Mechanism, 42A . . . Input Shaft, 50 . . . AT-ECU (Control Means or Control Section), 51 . . . Turbine Runner Rotation Speed Sensor.

The invention claimed is:

1. A control device for an internal combustion engine, the engine including an EGR device having an EGR passage for introducing exhaust gas from an exhaust passage into an intake passage and an EGR valve arranged in the EGR passage and which varies the amount of the exhaust gas introduced into the intake passage, the control device comprising:

a fuel cutoff control section that performs fuel cutoff control by which fuel supply to the engine is blocked, and suspends the fuel cutoff control in a condition in which engine speed becomes lower than or equal to a predetermined resumption engine speed when the fuel cutoff control is being carried out;

a diagnosis section that forcibly opens and closes the EGR valve when the fuel cutoff control section is performing the fuel cutoff control, and diagnoses whether an abnormality has occurred in the EGR device based on extent of pressure change in the intake passage caused by opening and closing the EGR valve; and a forcible suspension section that, when the diagnosis section is performing the diagnosis, suspends the diagnosis in a condition in which the engine speed becomes lower than or equal to a predetermined forcible suspension engine speed equal to or greater than the resumption engine speed, wherein the forcible suspension section sets a smaller value as the forcible suspension engine speed when the EGR valve is not in a forcibly opened state than when the EGR valve is in the forcibly opened state.

2. The control device for an internal combustion engine according to claim 1, wherein the forcible suspension section sets the forcible suspension engine speed in such a manner that the difference between the forcible suspension engine speed and the resumption engine speed is a smaller value when the EGR valve is not in the forcibly opened state than when the EGR valve is in the forcibly opened state.

3. The control device for an internal combustion engine according to claim 2, wherein:

the fuel cutoff control section sets the resumption engine speed variably in accordance with an engine operating state; and the forcible suspension section sets the forcible suspension engine speed in such a manner that the greater the resumption engine speed, the smaller the difference between the forcible suspension engine speed and the resumption engine speed becomes.

4. The control device for an internal combustion engine according to claim 1, wherein:

the engine is connected to a transmission through a clutch in a power transmissible manner; and when the EGR valve is in the forcibly opened state, the forcible suspension section sets the forcible suspension engine speed to a greater value when the rotation speed of an output shaft of the clutch and the engine speed differ from each other to a great extent than when such extent is small.

5. The control device for an internal combustion engine according to claim 4, wherein:

the clutch is a torque converter configured as a fluid clutch and includes a pump impeller connected to an output shaft of the engine, a turbine runner connected to an input shaft of the transmission, and a lockup mechanism for mechanically connecting the pump impeller and the turbine runner to each other; and when the EGR valve is in the forcibly opened state, the forcible suspension section sets the forcible suspension engine speed to a greater value when the torque converter is in a non-lockup state than when the torque converter is in a lockup state.

6. The control device for an internal combustion engine according to claim 1, wherein, when the EGR valve is not in the forcibly opened state, the forcible suspension section sets the forcible suspension engine speed in such a manner that the forcible suspension engine speed becomes equal to the resumption engine speed.

7. The control device for an internal combustion engine according to claim 1, wherein, when performing the diagnosis, the diagnosis section forcibly opens the EGR valve from a fully closed state.

8. The control device for an internal combustion engine according to claim 1, wherein the diagnosis section uses an average of a plurality of pressure values detected in a predetermined period as the pressure in the intake passage.

9. The control device for an internal combustion engine according to claim 1, wherein the forcible suspension section sets the forcible suspension engine speed only when the diagnosis section is performing the diagnosis.

10. A control device for an internal combustion engine, the engine including an EGR device having an EGR passage for introducing exhaust gas from an exhaust passage into an intake passage and an EGR valve arranged in the EGR passage and which varies the amount of the exhaust gas introduced into the intake passage, the control device comprising:

a fuel cutoff control section that performs fuel cutoff control by which fuel supply to the engine is blocked, and suspends the fuel cutoff control during a condition in which engine speed becomes lower than or equal to a predetermined resumption engine speed when the fuel cutoff control is being carried out;

a diagnosis section that forcibly opens and closes the EGR valve when the fuel cutoff control section is performing the fuel cutoff control, and diagnoses whether an abnormality has occurred in the EGR device based on extent of pressure change in the intake passage caused by opening and closing the EGR valve; and a forcible suspension section that, when the diagnosis section is performing the diagnosis, suspends the diagnosis in a condition in which the engine speed becomes lower than or equal to a predetermined forcible suspension engine speed equal to or greater than the resumption engine speed, wherein, when the diagnosis section is performing the diagnosis, the forcible suspension section updates the forcible suspension engine speed at predetermined cycles in accordance with a latest open/closed state at the time of the EGR valve, and sets the forcible suspension engine speed in such a manner that an allowance of the forcible suspension engine speed with respect to the resumption engine speed is a smaller value when the EGR valve is not in a forcibly opened state than when the EGR valve is in the forcibly opened state.

11. The control device for an internal combustion engine according to claim 10, wherein the fuel cutoff control section sets the resumption engine speed variably in accordance with an engine operating state.

12. The control device for an internal combustion engine according to claim 11, wherein the forcible suspension section sets the forcible suspension engine speed in such a manner that the greater the resumption engine speed, the smaller the allowance with respect to the resumption engine speed becomes.

13. The control device for an internal combustion engine according to claim 10, wherein:

the engine is connected to a transmission through a clutch in a power transmissible manner; and when the EGR valve is in the forcibly opened state, the forcible suspension section sets the forcible suspension engine speed in such a manner that the allowance with respect to the resumption engine speed has a greater value when the rotation speed of an output shaft of the clutch and the engine speed differ from each other to a great extent than when such extent is small.

14. The control device for an internal combustion engine according to claim 13, wherein:

the clutch is a torque converter configured as a fluid clutch and includes a pump impeller connected to an output shaft of the engine, a turbine runner connected to an input shaft of the transmission, and a lockup mechanism for mechanically connecting the pump impeller and the turbine runner to each other; and the control device further includes a control section that outputs a command signal to the lockup mechanism and controls to switch the torque converter to either a lockup state or a non-lockup state by changing an output mode of the command signal.

15. The control device for an internal combustion engine according to claim 14, wherein, when the command signal instructing the torque converter to switch to the lockup state is not output from the control section, the forcible suspension section sets the forcible suspension engine speed with the allowance with respect to the resumption engine speed set to a maximum value.

16. The control device for an internal combustion engine according to claim 14, wherein, when the rotation speed of the turbine runner and the engine speed differ from each other to an extent that is less than a predetermined extent, the forcible suspension section sets the forcible suspension engine speed in such a manner that, the greater the resumption engine speed, the smaller the allowance with respect to the resumption engine speed becomes.

17. The control device for an internal combustion engine according to claim 10, wherein, when the EGR valve is not in the forcibly opened state, the forcible suspension section sets the forcible suspension engine speed in such a manner that the forcible suspension engine speed becomes equal to the resumption engine speed.

18. The control device for an internal combustion engine according to claim 10, wherein, when performing the diagnosis, the diagnosis section forcibly opens the EGR valve from a fully closed state.

19. The control device for an internal combustion engine according to claim 10, wherein the diagnosis section uses an average of a plurality of pressure values detected in a predetermined period as the pressure in the intake passage.

20. The control device for an internal combustion engine according to claim 10, wherein the forcible suspension section sets the forcible suspension engine speed only when the diagnosis section is performing the diagnosis.

* * * * *